US006907387B1

(12) United States Patent
Reardon

(10) Patent No.: US 6,907,387 B1
(45) Date of Patent: Jun. 14, 2005

(54) SYSTEMS AND METHODS FOR REMOTE MONITORING OF A FACILITY LOCATION

(75) Inventor: George Ronald Reardon, Lawrenceville, GA (US)

(73) Assignee: BellSouth Intellectual Property Corporation, WIlimington (DE)

( * ) Notice: Subject to any disclaimer, the term of this patent is extended or adjusted under 35 U.S.C. 154(b) by 0 days.

(21) Appl. No.: 10/212,432

(22) Filed: Aug. 5, 2002

(51) Int. Cl.[7] ..... G06G 11/30
(52) U.S. Cl. ..... 702/188; 340/506
(58) Field of Search ..... 702/31, 32, 48, 702/57–59, 80, 94, 99, 103, 119, 151–153, 175, 177, 188; 340/539.22, 573.4, 588; 348/14.09, 155, 169

(56) References Cited

U.S. PATENT DOCUMENTS 4,051,522 A * 9/1977 Healy et al. ..... 725/78
4,916,435 A * 4/1990 Fuller ..... 340/573.4
4,999,614 A * 3/1991 Ueda et al. ..... 340/588
5,382,943 A * 1/1995 Tanaka ..... 340/539.22
5,585,839 A * 12/1996 Ishida et al. ..... 348/14.09
5,602,585 A * 2/1997 Dickinson et al. ..... 348/155
5,696,492 A * 12/1997 Sakamaki et al. ..... 340/573.1
5,801,618 A * 9/1998 Jenkins ..... 340/426.14
5,842,978 A * 12/1998 Levy ..... 600/300
6,049,281 A * 4/2000 Osterweil ..... 340/573.4
6,097,429 A * 8/2000 Seeley et al. ..... 348/154
6,404,455 B1 * 6/2002 Ito et al. ..... 348/169
6,611,206 B2 * 8/2003 Eshelman et al. ..... 340/573.1
2002/0147982 A1 * 10/2002 Naidoo et al. ..... 725/105
2004/0004542 A1 * 1/2004 Faulkner et al. ..... 340/506

* cited by examiner

*Primary Examiner*—Marc S. Hoff
*Assistant Examiner*—Mohamed Charioui
(74) *Attorney, Agent, or Firm*—Potomac Patent Group PLLC

(57) ABSTRACT

A system is provided for monitoring an individual at a monitored location within a facility. The system includes a first monitoring device positioned within the monitored location of the facility, the first monitoring device being configured for collecting at least video data associated with the monitored location, the first monitoring device including at least one of a camera, a microphone, a speaker and an alarm system. The system also includes a communications interface for receiving at least one data transmission from the first monitoring device. The system also includes a second monitoring device positioned at a monitoring location located remotely with respect to the first monitoring device, the second monitoring device being configured for receiving the data transmission and transmitting communications to the first monitoring device. A related method is also provided for determining occurrence of an event associated with an individual at a monitored location within a facility.

19 Claims, 4 Drawing Sheets

SYSTEMS AND METHODS FOR REMOTE MONITORING OF A FACILITY LOCATION

BACKGROUND

The present invention generally relates to methods and systems for monitoring, analyzing and communicating information related to activity occurring in a monitored location from a remote location.

In a variety of contexts and situations in modern society, an individual may be forced to reside within a facility for an indeterminate and possibly lengthy amount of time. Effective monitoring of the individual is often desirable and necessary to promote the welfare of the individual who is confined to the facility.

A patient in a long-term healthcare facility, for example, may be forced to reside in a room of the healthcare facility where the patient can rest and where medical treatment can be readily administered to the patient. Due to a severe medical condition, the patient may need to reside within the room for extended periods of time. Visitation by family or friends of the patient is often desirable to promote the present comfort and future recuperation of the patient. When the patient must remain in the healthcare facility for a protracted length of time, however, visitors of the patient may need to attend to the patient frequently at various times of the day and night during the patient's stay at the healthcare facility. In some situations, friends, family and other visitors of the patient may need to share the burden of visitation periods for the patient, particularly if the medical condition of the patient is dire and requires substantially constant attention. It can be appreciated that repeated and prolonged periods of visitation can be mentally, physically and emotionally draining for the visitors seeking to comfort the patient in the healthcare facility.

SUMMARY

In one embodiment of the present systems and methods, a system is provided for monitoring an individual at a monitored location within a facility. The system includes a first monitoring device positioned within the monitored location of the facility, the first monitoring device being configured for collecting at least video data associated with the monitored location, the first monitoring device including at least one of a camera, a microphone, a speaker and an alarm system. The system also includes a communications interface for receiving at least one data transmission from the first monitoring device. The system also includes a second monitoring device positioned at a monitoring location located remotely with respect to the first monitoring device, the second monitoring device being configured for receiving the data transmission from the communications interface, the second monitoring device being employable to operate at least one function of the first monitoring device.

In one embodiment of the present methods and systems, a method is provided for determining occurrence of an event associated with an individual at a monitored location within a facility. The method includes capturing at least a first sequence of video data associated with the monitored location of the facility using a monitoring device positioned in the monitored location; capturing at least a second sequence of video data associated with the monitored location using the monitoring device; analyzing the first and second sequences of video data with at least a server of a network data processor for determining occurrence of the event at the monitored location; and, transmitting event data associated with the event to at least one data storage. In another aspect, the method includes applying an event-tag to the event. In still another aspect, the method includes indexing the event data in the data storage. In still another aspect, the method includes remotely activating an alarm system operatively associated with the monitoring device.

Various computer-readable media embodiments associated with the present methods and system are also provided.

DESCRIPTION

As used herein, the term "facility" includes any institution in which one or more individuals may reside and/or are confined within one or more locations of the institution for a period of time. One example of an individual in a facility is a patient receiving medical treatment for a medical condition in a healthcare facility. Other examples of facilities include prisons, retirement homes, convalescent homes, private residences and any other environment that possesses one or more locations in which individuals may reside and be monitored.

The term "monitored location" as used herein includes a portion of a facility for which activity information is desired to be monitored, analyzed, stored, and/or communicated. One such monitored location may be the room of a patient in a healthcare facility, for example.

As used herein, the term "station" includes any area or individual or group of individuals within the facility that maintains at least partial responsibility for the monitored location and the welfare of an individual within the monitored location.

The term "monitoring location" as applied herein includes any location that is external to a monitored location and which is suitable for practicing the monitoring, analysis and communication systems and methods discussed herein.

The term "event" includes any activity occurring at a monitored location, the occurrence of which is desirable to be monitored, analyzed, stored, and/or communicated.

As applied herein, the term "sequence" includes one or more pieces of similarly related information or data such as, for example and without limitation, frames of digital video, frames of digital audio, bytes of digital video and/or audio data, and other related information.

The term "event data" includes data that can be collected in association with occurrence of an event. Examples of event data include time of the event, date of the event, audio associated with the event, video associated with the event, environmental conditions (such as temperature, for example) associated with a monitored location in which the event occurs, an "event-tag" that identifies the event as such, and other like data. An "event-tag" includes application of at least one criterion to a sequence for determining whether an activity that has occurred should be deemed an event worthy of analysis, storage and other additional processing. An example of an event-tag is a predetermined amount of change in pixel quantity associated with a particular color from a first video sequence to a subsequent video sequence. Change in pixel quantity of a particular color from one sequence to a subsequent sequence may indicate, for example, the presence of a healthcare professional or another visitor within a monitored location.

Figure 1:
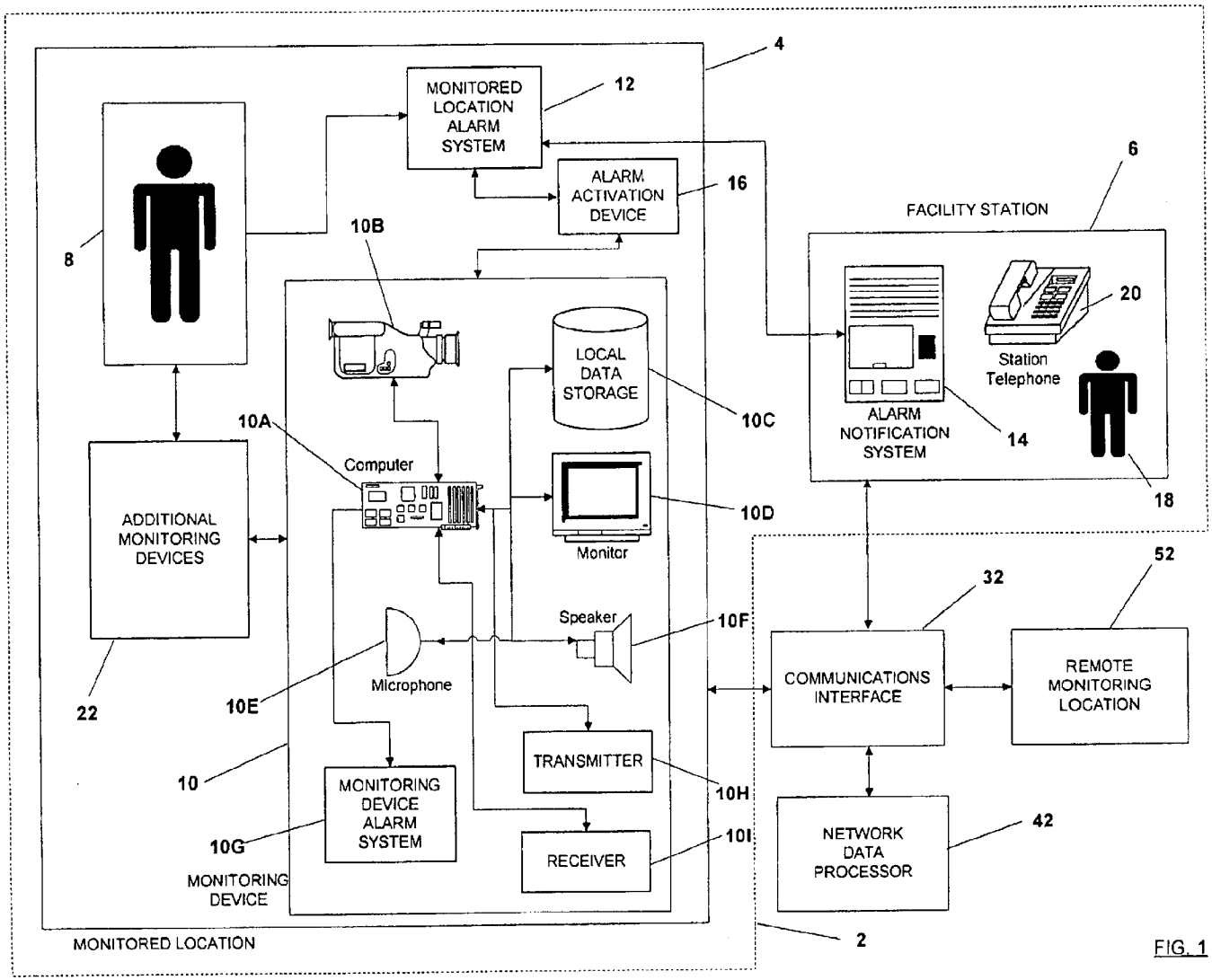
FIG. 1 is a functional block diagram depicting one embodiment of a system for monitoring the activity of an individual within a monitored location in accordance with the present systems and methods.
Figure 2:
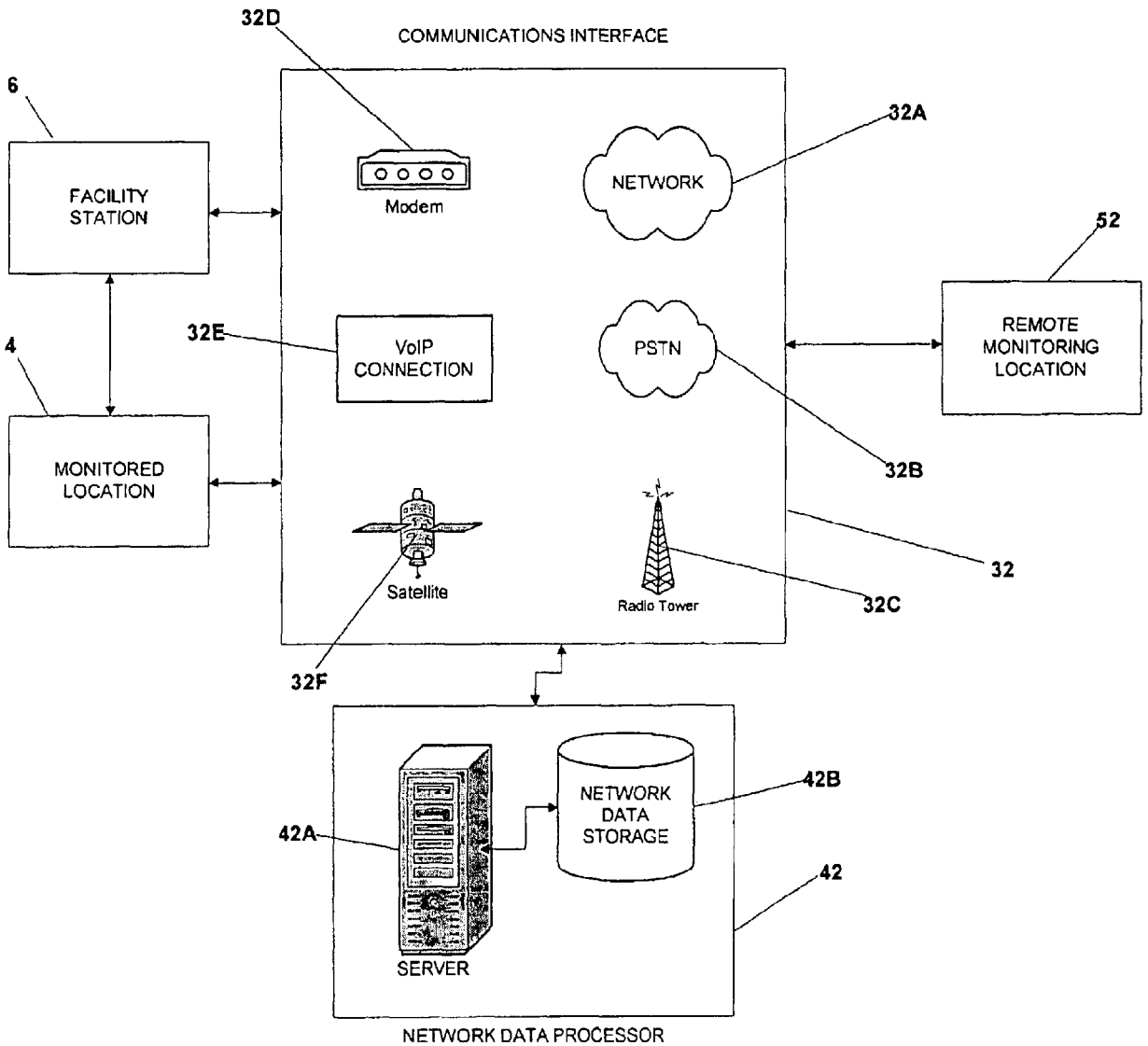
FIG. 2 is a functional block diagram depicting various features of the system of FIG. 1 in more detail.
Figure 3:
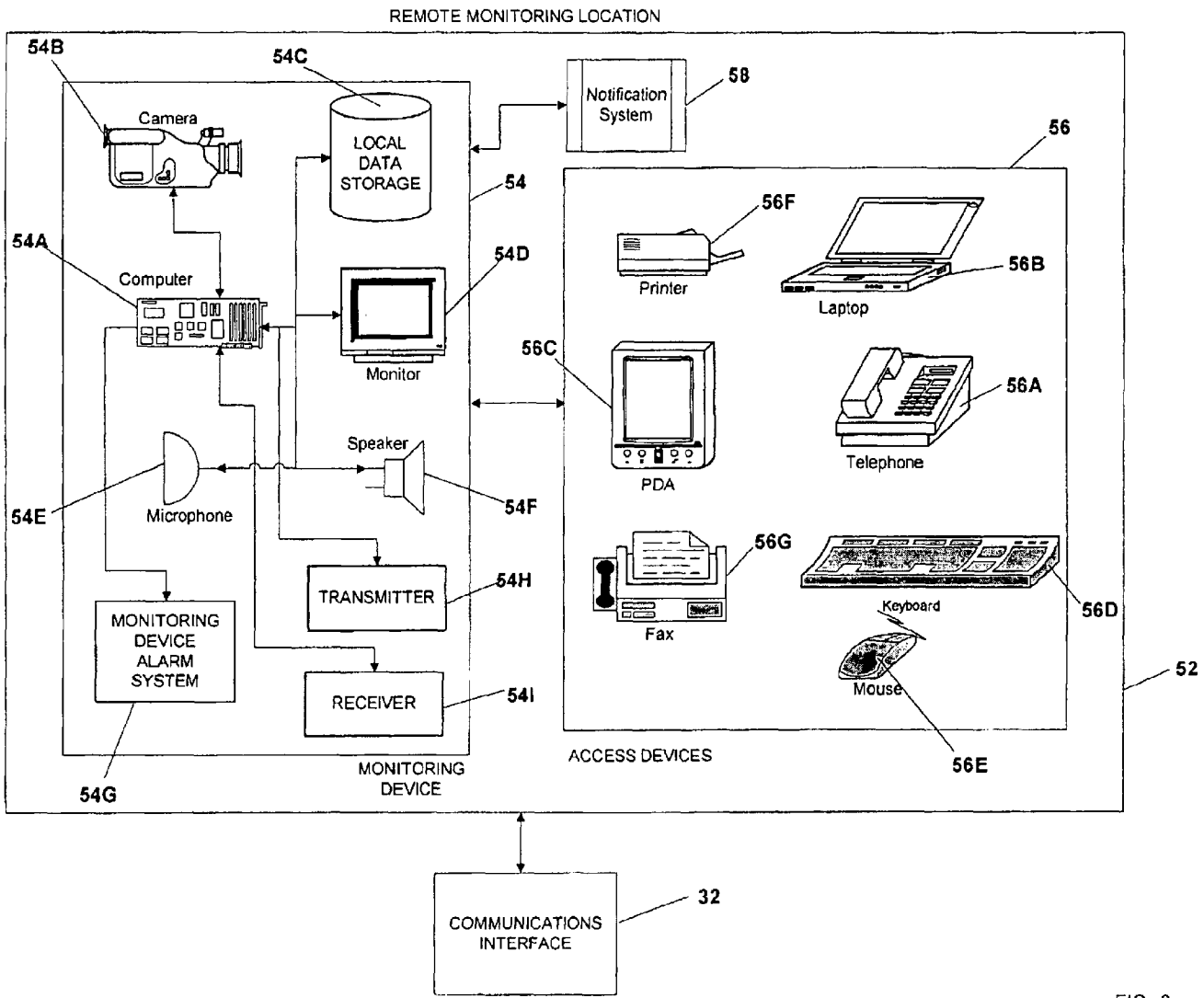
FIG. 3 is a functional block diagram depicting various features of the system of FIG. 1 in more detail; and, FIG. 4 is a process flow diagram illustrating one embodiment of a method for monitoring and analyzing one or more events associated with a monitored location in accordance with the present systems and methods.
Figure 4:
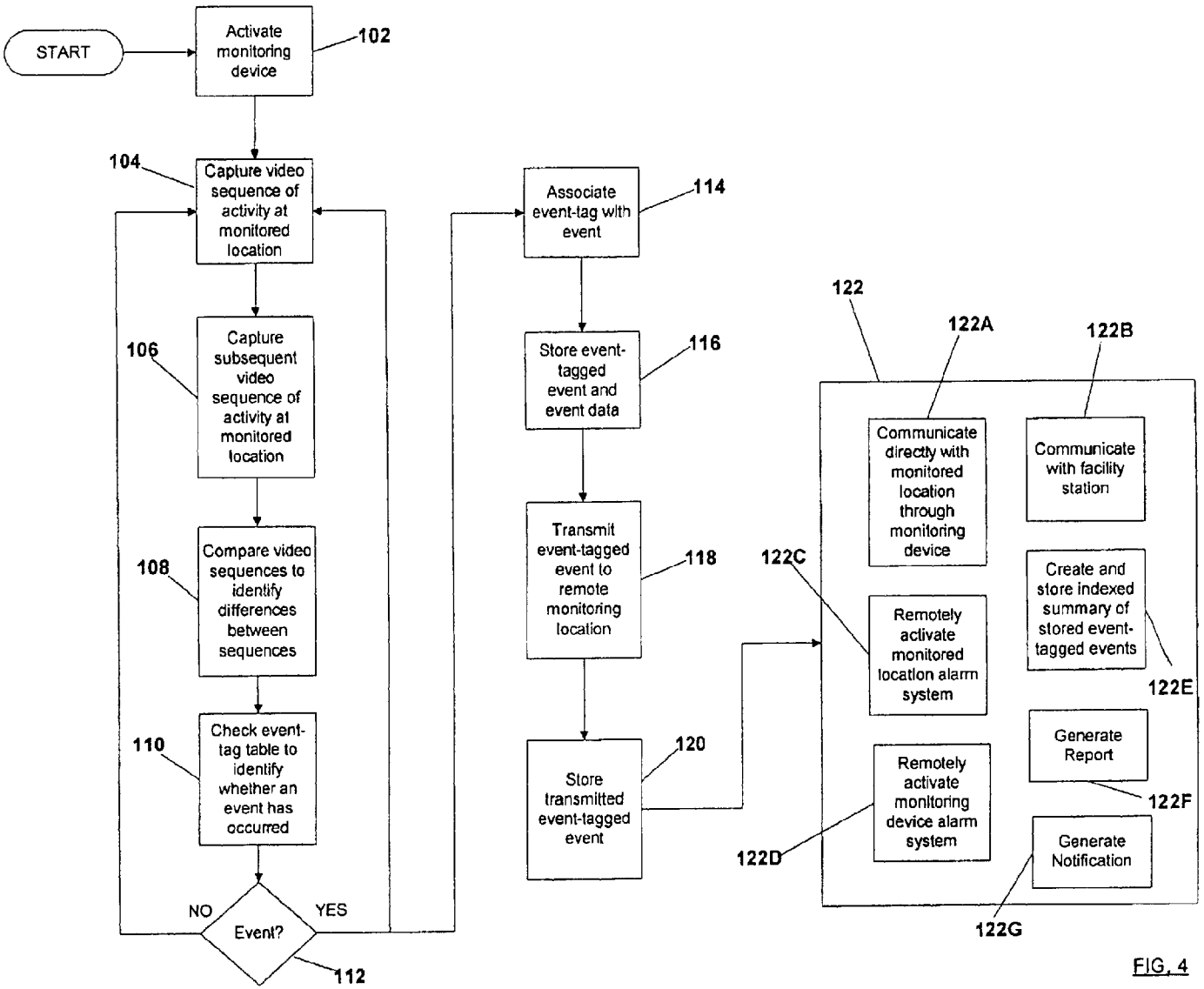

Referring now to FIGS. 1 through 3, one embodiment of a system for monitoring and analyzing events and associated event data occurring within a monitored location is provided. A facility 2 includes a monitored location 4 and a facility station 6 associated with the monitored location 4. As shown in FIG. 1, the monitored location 4 may include an individual 8 whose activity, behavior and general condition are being monitored by a monitoring device 10 positioned for effective operation within the monitored location 4.

Within the monitored location 4, the individual 8 can have access to a monitored location alarm system 12 that permits the individual 8 to activate an alarm notification system 14 located at the facility station 6. The monitored location alarm system 12 can be a conventional alarm system of the type employed by a patient in a hospital room, for example, which can be used to alert a healthcare professional of a particular need of the patient. Such conventional alarm systems may employ push button or pull cord configurations, for example, to permit the patient to alert healthcare professionals or other healthcare providers such as nurses, for example.

In one embodiment, an alarm activation device 16 can be provided as an interface between the monitored location alarm system 12 and the monitoring device 10. The alarm activation device 16 can be configured to respond to a command of the monitoring device 10 to activate the monitored location alarm system 12. The alarm activation device 16 can be operated from the monitoring device 10 by a wireline or wireless connection to the monitoring device 10. In one aspect, components of the alarm activation device 16 used to activate the monitored location alarm system 12 may include electrical components (e.g., hardware and software) that are integrated with the electrical components of the monitored location alarm system 12 (e.g., such as in the situation where a push button is pressed to activate a switch within the monitored location alarm system 12). In another aspect, components of the alarm activation device 16 used to activate the monitored location alarm system 12 may include mechanical components (e.g., a clamp and actuator arm configuration with one or more fingers) that are operatively coupled with mechanical components of the monitored location alarm system 12 (e.g., such as in the situation where a cord is pulled or a button is pushed to activate the monitored location alarm system 12).

In addition, personnel 18 of the facility 2 are located at the facility station 6 to attend to the alarm notification system 14. The facility station 6 can also be equipped with a telephone 20, for example, or another wireless or wireline communication device, to permit the personnel 18 to communicate with other healthcare professionals of the facility 2 or with friends, family or other visitors of the individual 8.

Within the monitored location 4, the individual 8 may be connected to or operatively associated with one or more additional monitoring devices 22. As shown in FIG. 1, the additional monitoring devices 22 can also communicate with the monitoring device 10. The additional monitoring devices 22 may include, for example and without limitation, a heart rate monitor, a blood pressure monitor, a medication dispensation monitor, a brain function monitor, and a variety of other like medical devices that measure physical and mental functions and conditions of the individual 8. Information gathered by these medical monitoring devices 22 can be communicated to the monitoring device 10 for analysis, storage and further action to be taken in response to the gathered information. Another example of one of the additional monitoring devices 22 is a motion sensor positioned within the monitored location 4. It can be appreciated that such a motion sensor can communicate information about movement of the individual 8 and, more generally, about movement within the monitored location 4 to the monitoring device 10.

In one aspect of the present systems and methods, the monitoring device 10 is directly operatively associated with one or more of the additional monitoring devices 22, such as by a wireline or wireless connection between the components of the monitoring device 10 and one or more of the additional monitoring devices 22. The function of the monitoring device 10 to view and record information about the monitored location 4 may also be used to obtain visual information generated and displayed by the additional monitoring devices 22.

In one embodiment of the present systems and methods, the monitoring device 10 includes a computer 10A and a number of other components 10B–10I that permit the monitoring device 10 to obtain and process information gathered from the monitored location 4. A camera 10B is provided for viewing the individual 8 and the monitored location 4 and for collecting video data associated with activity and events that occur within the monitored location 4. In one embodiment, the camera 10B includes a web-enabled digital camera that can collect digital representations of the monitored location 4. Video data collected by the camera 10B can be stored on a local data storage 10C of the monitoring device 10. The monitoring device 10 may also have a monitor 10D that shows a view of another remote location. The monitor 10D may also show an indexed summary of events and event data captured by the camera 10B for a given time period.

In one aspect, at least one microphone 10E is also provided in the monitoring device 10 for receiving audible signals such as noise and conversation occurring within the monitored location 4. In another aspect, at least one speaker 10F is also provided in the monitoring device 10 for broadcasting audio signals from the monitoring device 10. A monitoring device alarm system 10G can also be provided that can generate an audio, visual or audio/visual alarm based on an external input received by the monitoring device 10. Such an external input might be provided by the additional monitoring equipment 22, for example, if a criterion (e.g., a blood pressure level) associated with the medical condition of the individual 8 should deviate from an acceptable level.

The monitoring device 10 can also have a transmitter 10H for transmitting video, audio, text, numbers and other types of data and information from the monitoring device 10 in digital or analog format. The monitoring device 10 can also have a receiver 10I for receiving video, audio, text, numbers and other types of data in digital or analog format from a device or location that is external to the monitoring device 10. Information received by the monitoring device 10 may include, for example, instructions to activate the speaker 10F of the monitoring device 10 to deliver an audio message to the individual 8 or another person in the monitored location 4.

In various embodiments of the present methods and systems, in operation of the monitoring device 10, data and information are transmitted through a communications interface 32 to at least one of the facility station 6, a network data processor 42 and a remote monitoring location 52.

As shown in FIG. 2, the network data processor 42 includes at least a server 42A and a network data storage 42B. The server 42A of the network data processor 42 includes software for receiving data, such as event data, from the monitoring device 10 and storing the event data in the network data storage 42B. The network data storage 42B is configured to receive and store data, such as digitized video data, for example, transmitted from the monitoring device 10.

In one embodiment of the operation of the monitoring device 10, the camera 10B receives images of activity occurring within the monitored location 4. In certain aspects, these images can be stored locally on the monitoring device 10 in the local data storage 10C or transmitted to the network data processor 42 for storage in the network data storage 42B. All or just a portion of the video data collected from activities associated with the monitored location 4 may be stored in either the local data storage 10C or the network data storage 42B. The server 42A of the network data processor 42 may also function to compare separate sequences or portions of video data to identify whether an event has occurred within the monitored location 4 during a given time period. In another aspect, the camera 10B, in operative connection with the network data processor 42, can identify changes in the infrared spectra associated with various views of the monitored location 4. In conjunction with this comparison analysis, the network data storage 42B may include one or more tables including one or more event-tags that can be applied as criteria for the comparison analysis to determine whether an event has occurred. Once such event-tags are applied to analyze sequences, the local data storage 10C and/or the network data storage 42B can be employed to index and store a listing of events that have occurred within a particular time period. The video, audio and other event data stored in the local data storage 10C and/or the network data storage 42B can be compiled, as a whole or in pertinent part, in one or more reports of events that have occurred at the monitored location 4.

In another embodiment of the present methods and systems, the monitoring device 10 may employ the computer 10A in connection with the network data processor 42 to identify not only movement at the monitored location 4, but also the type of activity occurring at the monitored location 4. Conventional face recognition software may be employed, for example, to identify the entry of a particular visitor in the monitored location 4. Conventional software may be applied to identify a particular color of uniform, for example, of a person entering the monitored location 4. A visitor dressed in green, for example, might be designated to indicate that the individual 8 in the monitored location 4 is being provided with food. Another visitor dressed in white, for example, might be designated to indicate that the individual 8 is receiving healthcare from a healthcare professional such as a nurse, for example. In one embodiment, such events can also be associated with a text message, for example, that is stored in the local data storage 10C or on the network data storage 42B that reflects the event that has occurred. In another aspect, the text message may be coupled with time and date information, for example, such that a message reading, "Individual fed in room at 10:00 p.m. on Feb. 1, 2004" can be stored and/or displayed for future reference. It can be seen that indexing event-tagged events with its associated event data can facilitate searches and report generation in association with preparing summaries of events occurring at the monitored location 4 within a given time period.

In one embodiment of the present methods and systems, the monitoring device 10 and the facility station 6 are operatively linked to the communications interface 32. This link to the communications interface 32 permits information collected from the monitored location 4 to be processed by the network data processor 42 and/or transmitted to a remote monitoring location 52. As shown in FIG. 2, the communications interface 32 can include one or more methods and systems, alone or in reasonable combination, for transmitting information to/from the monitoring device 10 at the monitored location 4, the network data processor 42 and/or the facility station 6. In various embodiments of the present methods and systems, the communications interface 32 can include, for example and without limitation, connection through a network 32A, such as an intranet or the Internet; a connection to the Public Switched Telephone Network (PSTN) 32B; a wireless connection through a radio tower 32C; connection through a modem 32D; a voiceover-IP (VoIP) connection 32E; a wireless connection through a satellite; and/or a reasonable combination of one or more of these methods and systems for communication.

In another embodiment of the present methods and systems, a remote monitoring location 52 can be linked to the communications interface 32 that includes a monitoring device 54 and one or more access devices 56 linked to the monitoring device 54. In one aspect, the monitoring device 54 and its components 54A–54I can be substantially similar in structure and configuration to the monitoring device 10 at the monitored location 4 and its components 10A–10I. It can be seen that a visitor who wishes to view and possibly interact with the individual 8 at the monitored location 4 can employ an access device 56 to gather information about the condition and environment of the individual 8. Examples of access devices 56 (as shown in FIG. 3) that can be used to communicate with the monitoring device 54 include, for example and without limitation, a telephone 56A; a laptop computer 56B; a personal digital assistant (PDA) 56C; data entry and manipulation devices such as a keyboard 56D and a mouse 56E; and/or devices for printing reports and other information such as a printer 56F and a facsimile device 56G. It can be appreciated that one or more of these access devices 56, alone or in reasonable combination, can be employed to collect, analyze, store and otherwise process data obtained from the monitored location 4.

In one example, the keyboard 56D can be used to enter a query that retrieves event-tagged event data from the network data storage 42B through the communications interface 32. In another example, in the event that the condition of the individual 8 requires immediate attention as shown on the monitor 54D of the monitoring device 54, the mouse 56E can be used to select an option that activates the monitoring device alarm system 10G of the monitoring system 10 that operates at the monitored location 4. In another example, the telephone 56A can be used to communicate with personnel 18 at the facility station 6 to request a status check on the condition of the individual 8 residing at the monitored location 4. In still another example, the PDA 56C can be employed to access an Internet site through a network 32A connection with the communications interface 32. The Internet site may contain a table or index of event-tagged events associated with the monitored location 4 that can be viewed with video data, in whole or pertinent part, by a visitor of the individual 8. In still another example, a visitor can use the microphone 54E of the monitoring device 54 at the remote monitoring location 52 to interact with the individual 8 through the speaker 10F of the monitoring device 10 positioned at the monitored location 4. It can be appreciated that this list of illustrative functions is not exhaustive, however, and that a multitude of potential communications and operations are possible within the scope of the present methods and systems.

Referring now to FIGS. 1 through 4, one illustrative embodiment is provided for a method for collecting and processing data in connection with monitoring activity occurring at the monitored location 4. In step 102, the monitoring device 10 is activated to begin monitoring the monitored location 4. In step 104, a video sequence of the monitored location 4 is captured by the camera 10B along with audio information captured by the microphone 10E. The camera 10B continues to collect subsequent video data in step 106. In step 108, this subsequent video data is compared to the video data obtained in step 104 to identify potential differences between the sequences. The event-tag table can be checked in step 110 to determine whether the differences between the sequences constitute a recordable event.

If it is determined in step 112 that no recordable event has occurred, then the camera 10B resumes capturing video data in step 104. If it is determined in step 112 that a recordable event has occurred, then an event-tag is associated with the event in step 114. In step 116, the event-tagged event and other event data can be stored, in whole or pertinent part, in one or more of the local data storages 10C, 54C and/or the network data storage 42B. In step 118, information associated with the recorded event can be transmitted to the monitoring device 54 at the remote monitoring location 52. In step 120, the monitoring device 54 can store the transmitted, event-tagged event data in the local storage 54C and/or the network data storage 42B.

In step 122, in various embodiments of the present methods and systems, one or more steps may be performed. In step 122A, a visitor at the remote monitoring location 52 may choose to communicate directly with the individual 8 at the monitored location 4, such as by employing the camera 54B and the microphone 54E of the monitoring device 54, for example. In step 122B, the visitor may choose to communicate directly with the facility station 6, such as by using the telephone 56A at the remote monitoring location 52 to call the telephone 20 at the facility station 6. In step 122C, the visitor may decide to activate the monitored location alarm system 12 such as by employing a function of the monitoring device 54 to access the alarm activation device 16 through the communications interface 32. In step 122D, the visitor can remotely activate the monitoring device alarm system 10G of the monitoring device 10, such as by accessing an equivalent functionality in the monitoring device alarm system 54G of the monitoring device 54 at the remote monitoring location 52. In step 122E, an indexed summary of event-tagged events can be created and stored for future reference, such as by generating a report of event-tagged events through the network data processor 42 in step 122F.

In another aspect of the present methods and systems, a notification system 58 can be operatively associated with the monitoring device 54. The notification system 58 can include one or more alarms of an audio, visual or audio/visual configuration that, once activated, can alert a visitor at the remote monitoring location 52 that an event has occurred that requires action to be taken. Another example of an alarm employed by the notification system 58 is a mechanism that vibrates to alert the visitor at the remote monitoring location 52. The notification system 58 can be programmed and configured to retrieve and analyze event-tagged data and match the event-tagged data against one or more predetermined criteria. If a match is achieved between/among the event-tagged data and the predetermined criteria, then the notification system 58 can be instructed to generate a notification in step 122G by activating one or more of its alarms. For example, if the event-tagged data indicates that a green-colored uniform is positioned in the monitored location 4, then the notification system 58 may activate a red light alarm that indicates to a visitor in the remote monitoring location 52 that a health care professional is with the individual 8.

The benefits of the present methods and systems are readily apparent to those skilled in the art. The present methods and systems provide a variety of effective ways to collect, analyze, store and otherwise process data associated with an individual residing within a monitored location at a facility.

The examples presented herein are intended to illustrate potential implementations of the present method and system embodiments. It can be appreciated that such examples are intended primarily for purposes of illustration of the present methods and systems to those skilled in the art. No particular aspect or aspects of the example method and system embodiments described herein are intended to limit the scope of the present invention.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

The term "computer system" as applied herein may include, without limitation, one or more of the following devices: a wireless personal computer, a laptop, a personal digital assistant (PDA), a wireless pager, and a "computer" may be a microcomputer, minicomputer, laptop, personal data assistant, cellular phone, two-way pager, processor, and any other computerized device capable of transmitting, receiving and/or processing data for transmission over a wireless network, a wireline network or a shared network.

The term "computer-readable medium" is defined herein as understood by those skilled in the art. It can be appreciated that various method steps described herein may be performed, in certain embodiments, using instructions stored on a computer-readable medium or media that direct a computer system to perform the method steps. A computer-readable medium can include, for example, memory devices such as diskettes, compact discs of both read-only and writeable varieties, optical disk drives, and hard disk drives. A computer-readable medium can also include memory storage that can be physical, virtual, permanent, temporary, semi-permanent and/or semi-temporary. A computer-readable medium can further include one or more data signals transmitted on one or more carrier waves.

It can be appreciated that, in some embodiments of the present methods and systems disclosed herein, a single component can be replaced by multiple components, and multiple components replaced by a single component, to perform a given function. Except where such substitution would not be operative to practice the present methods and systems, such substitution is within the scope of the present invention.

Whereas particular embodiments of the invention have been described herein for the purpose of illustrating the invention and not for the purpose of limiting the same, it can be appreciated by those of ordinary skill in the art that numerous variations of the details, materials and arrangement of parts may be made within the principle and scope of the invention without departing from the invention as described in the appended claims.

What is claimed is:

1. A method for determining an occurrence of an event associated with an individual at a monitored location within a facility, said method comprising:

capturing at least a first sequence of video data associated with said monitored location of said facility using a monitoring device positioned in said monitored location;

capturing at least a second sequence of video data associated with said monitored location using said monitoring device;

analyzing said first and second sequences of video data with at least a server of a network data processor for determining occurrence of said event at said monitored location, wherein said analyzing includes identifying at least one color of a uniform associated with a person entering said monitored location;

transmitting event data associated with said event to at least one data storage; and applying an event-tag to said event data, wherein said event-tag includes a text message descriptive of a service provided to said individual by said person entering said monitored location, content of said text message depending at least in part on said identified uniform color and including time and date information.

2. The method of claim 1, further comprising transmitting at least one of said first sequence of video data, said second sequence of video data, and said event-tagged event data to a remotely located monitoring location.

3. The method of claim 1, further comprising generating a notification based on said event data.

4. The method of claim 1, further comprising indexing said event data in said data storage.

5. The method of claim 1, further comprising storing at least one of said first sequence of video data, said second sequence of video data, and said event data in said data storage.

6. The method of claim 1, further comprising remotely activating an alarm system operatively associated with said monitoring device.

7. The method of claim 1, further comprising transmitting a communication to said monitored location by remotely accessing said monitoring device.

8. A system for determining an occurrence of an event associated with an individual at a monitored location within a facility, said system comprising:

means for capturing at least a first sequence of video data associated with said monitored location of said facility;

means for capturing at least a second sequence of video data associated with said monitored location;

means for analyzing said first and second sequences of video data with a network data processor means for determining occurrence of said event at said monitored location, wherein said analyzing means includes means for identifying at least one color of a uniform associated with a person entering said monitored location;

means for transmitting event data associated with said event to at least one data storage means; and means for applying an event-tag to said event data, wherein said event-tag includes a text message descriptive of a service provided to said individual by said person entering said monitored location, content of said text message depending at least in part on said identified uniform color and including time and date information.

9. The system of claim 8, further comprising means for transmitting at least one of said first sequence of video data, said second sequence of video data, and said event-tagged event to a remotely located monitoring location.

10. The system of claim 8, further comprising means for indexing said event data in said data storage means.

11. The system of claim 8, further comprising means for storing at least one of said first sequence of video data, said second sequence of video data, and said event data in said data storage means.

12. The system of claim 8, further comprising means for remotely activating an alarm system at said monitored location.

13. The system of claim 8, further comprising means for transmitting a communication to said monitored location.

14. A computer-readable medium including instructions for determining an occurrence of an event associated with an individual at a monitored location within a facility, said medium comprising instructions to perform the steps of:

capturing at least a first sequence of video data associated with said monitored location of said facility;

capturing at least a second sequence of video data associated with said monitored location;

analyzing said first and second sequences of video data with a network data processor for determining occurrence of said event at said monitored location, wherein said instructions for analyzing include instructions for identifying at least one color of a uniform associated with a person entering said monitored location;

transmitting event data associated with said event to at least one data storage; and applying an event-tag to said event data, wherein said event-tag includes a text message descriptive of a service provided to said individual by said person entering said monitored location, content of said text message depending at least in part on said identified uniform color and including time and date information.

15. The medium of claim 14, further comprising instructions for transmitting at least one of said first sequence of video data, said second sequence of video data, and said event-tagged event to a remotely located monitoring location.

16. The medium of claim 14, further comprising instructions for indexing said event data in said data storage means.

17. The medium of claim 14, further comprising instructions for storing at least one of said first sequence of video data, said second sequence of video data, and said event data in said data storage.

18. The medium of claim 14, further comprising instructions for remotely activating an alarm medium at said monitored location.

19. The medium of claim 14, further comprising instructions for transmitting a communication to said monitored location.

* * * * *